US005560193A

United States Patent [19]

Sekiya et al.

[11] Patent Number: 5,560,193

[45] Date of Patent: Oct. 1, 1996

[54] METHOD AND DEVICE FOR WINDING A ROVING IN A FLYER FRAME

[75] Inventors: Shigeki Sekiya, Kuwana; Yoshio Kurachi, Aichi, both of Japan

[73] Assignee: Howa Machinery, Ltd., Japan

[21] Appl. No.: 231,763

[22] Filed: Apr. 25, 1994

[30] Foreign Application Priority Data

Apr. 27, 1993 [JP] Japan ..... 5-125100

[51] Int. Cl.[6] ..... D01H 7/46; D01H 13/00

[52] U.S. Cl. ..... 57/264; 57/96; 57/277; 242/18.0 EW

[58] Field of Search ..... 57/264, 93, 95, 57/96, 98, 277, 276; 242/18 EW

[56] References Cited

U.S. PATENT DOCUMENTS

| | | | |
|---|---|---|---|
| 3,302,381 | 2/1967 | Pfeifer | 57/98 |
| 3,316,700 | 5/1967 | Mason et al. | 57/98 |
| 3,316,701 | 5/1967 | Mason et al. | 57/98 |
| 4,122,654 | 10/1978 | Oswald | 57/54 |
| 4,467,593 | 8/1984 | Araki | 57/264 |
| 4,569,192 | 2/1986 | Yamada et al. | 57/264 |
| 5,117,621 | 6/1992 | Feichtinger et al. | 57/276 |
| 5,259,179 | 11/1993 | Sekya et al. | 57/98 |
| 5,341,633 | 8/1994 | Nishikawa et al. | 57/93 |

FOREIGN PATENT DOCUMENTS

| | | | |
|---|---|---|---|
| 0386519A1 | 9/1990 | European Pat. Off. . | |
| 0503518A1 | 9/1992 | European Pat. Off. . | |
| 3-33230 | 2/1991 | Japan . | |
| 3-180525 | 8/1991 | Japan . | |
| 4-11028 | 1/1992 | Japan . | |
| 4-327222 | 11/1992 | Japan | 57/264 |

*Primary Examiner*—William Stryjewski

[57] ABSTRACT

When a residual amount R of a roving required to make a bobbin full at a desired stopping position A of the bobbin rail which moves upwardly is smaller than the amount (4×L) corresponding to remaining four layers of the roving for a normal winding process, a desired amount Q is calculated as the residual amount R divided by 4. The switching of the roving during the downward movement of the bobbin rail is done when the amount of the roving from the top end of the bobbin rail is equal to the desired spinning amount Q. This operation is repeated until a full bobbin amount is detected by an encoder, and the flyer frame is stopped.

10 Claims, 5 Drawing Sheets

METHOD AND DEVICE FOR WINDING A ROVING IN A FLYER FRAME

BACKGROUND OF THE INVENTION

1. Field of the Invention

The present invention relates to a method and apparatus for controlling the winding of a roving in a flyer frame, where the roving from a front roller is wound on a roving bobbin, while the direction of the movement of a bobbin rail is alternately switched.

2. Description of Related Art

In a spinning factory, flyer frames produce roving bobbins, which are conveyed to fine spinning frames, where the roving from the bobbins are subjected to a fine spinning process for producing spun yarns on cops, while emptied roving bobbins at the fine spinning frames are returned back to the flyer frames for re-use. Various automated operations have been developed in this field. Namely, in order to obtain an automated conveyance of full bobbins from the flyer frames to the fine spinning frames and of empty bobbins from the fine spinning frames to the flyer frames, a system has proposed, wherein a rail conveyor is provided for conveying full bobbins, being carried by bobbin carriages in a suspended condition, from the flyer frames to auxiliary rails of creels of the fine spinning frames, almost emptied bobbins held by the creels are replaced by the conveyed full bobbins, while rovings from the full bobbins are pieced to respective ends of rovings supplied to respective spinning units of the fine spinning frames, a roving stripper is provided for stripping residual roving on the almost emptied bobbins after the replacement, and the completely emptied bobbins are returned to the flyer frames for re-use.

In this system, the piecing of the full bobbins can be automatically executed as disclosed by Japanese Un-Examined Patent Publication No. 62-53425 and Japanese Un-Examined Patent Publication No. 64-52828. In such an automated piecing apparatus, an end of the roving on a bobbin is found and held by an air sucker, and a end of the roving shaped as a pointed brush shape is, while being held by a nipper, moved so as to be contacted with a roving supplied to a spinning unit from the almost emptied bobbin. A disengagement of the nipper causes the roving end of the full bobbin to be freed, causing it to be entrained by the supplied roving from the almost emptied bobbin to the spinning unit, thereby the roving from the full bobbin to be pieced to the roving from the emptied bobbin. Finally, the roving from the almost emptied bobbin is broken. In order to execute this kind of the piecing properly, it is required that the end of the roving in a full bobbin should be located on a predetermined vertical position, which allows the end of the roving to be positively engaged by the sucker. It is also required that the amount of the roving on a bobbin is fixed to a predetermined amount which corresponds to a predetermined length of a spun yarn produced by the following fine spinning process and corresponds to the amount of the spun yarn wound on a desired number of full cops. This latter requirement is generated from a necessity for reducing the amount of waste roving to be stripped from emptied roving bobbins when a doffing operation for exchanging the emptied bobbin with full bobbins is, from the view point of efficiency of automation, carried out simultaneously for all of the spindles in a flyer frame or for all of the spindles located on one side of the flyer frame.

In order to satisfy the above requirements, Japanese Un-Examined Patent Publication No. 3-180525 and Japanese Un-Examined Patent Publication No. 3-33230 disclose methods for winding a roving in a flyer frame, wherein a provision is made as to a device (encoder) for measuring the amount of roving to be issued and a device (encoder) for measuring the vertical position of a bobbin rail, and a residual amount of roving up to a full bobbin state is calculated as a predetermined amount of roving corresponding to the full bobbin state, minus the actual amount of roving wound on a bobbin at the instant. When this residual amount reaches a predetermined amount almost the same as the full bobbin state, a prediction is made, based on the actual position of the bobbin rail detected by the bobbin rail position detector at the instant, as to the position of the roving the full bobbin state. When it is determined that the predicted position of the roving at the full bobbin state is within a permissible range, switching of the bobbin rail up to the full bobbin state is effected at normally selected points. However, when it is determined that the predicted position of the roving upon the full bobbin state is out of the permissible range, switching points, which are different from the normally selected points and which are for causing the roving to be located in the permissible vertical range upon the full bobbin states are calculated. Thus, the switching of the bobbin rail up to the full bobbin state is effected at a different switching point, so that, upon the full bobbin state, the end of the roving is located within the permissible range of the vertical position. As a result, a full bobbin with the desired amount of roving as wound is obtained while the end of the roving is located at a position in the permissible vertical range.

However, the prior art is defective in that a process for controlling the winding of the roving is complicated due to the fact that a position of the roving end upon the full bobbin state is predicted when a residual amount of the roving is equal to a preset value, that positions of switching of the movement of the bobbin rail, which are different from normal positions, are calculated when it is determined that the predicted position is out of a permissible range, and that the bobbin rail is switched at the calculated positions by detecting the latter.

The prior art is defective also in that an encoder (sensor) is necessary to continuously monitor the vertical position of the bobbin rail, since a control is done so that the bobbin rail is reciprocated between varied vertical positions which are to be sensed.

SUMMARY OF THE INVENTION

An object of the present invention is to provide a method for controlling the winding of a roving in a flyer frame, capable of obtaining a desired vertical location of the end of the roving at a full bobbin state, without complicating the process for controlling the winding.

Another object of the present invention is to provide a system capable of eliminating an encoder for detecting a continuously varied position of a bobbin rail.

According to the present invention, a method for winding a roving in a flyer frame is provided, wherein the roving issued from a front roller of a draft part is taken up by a bobbin on a bobbin rail, which is normally reciprocated between vertically spaced locations to create a package of the roving with vertically spaced shoulders, and the bobbin rail is stopped at a desired vertical location when a predetermined full amount of the roving is wound on the bobbin, the method comprising the steps of:

providing means of measuring the amount of the roving issued from the front roller; providing means of obtaining a switching of the movement of the bobbin rail which is different from said normal reciprocating movement;

calculating, at the desired vertical location of the bobbin rail for the stoppage of the flyer frame, a residual amount of the roving until the full bobbin state is obtained, as the predetermined full amount of the roving at the full bobbin condition minus the actual amount of the roving on the bobbin measuredly the measuring means;

determining a condition where the calculated residual amount is equal to or less than the amount of the roving corresponding to layers of a first predetermined number during the normal winding process;

calculating, upon said determination, based on the calculated residual amount, a modified amount of the roving for layers of a second predetermined number until the full bobbin state is obtained, each of which corresponds to a stroke of the bobbin rail from a shoulder location, exceeding said desired vertical location for the stoppage and which makes the end of the roving to be situated at said desired location for the stoppage when the full bobbin state is obtained;

operating said switching means to obtain a switching of the bobbin rail at a location which makes the amount of the roving from a preceeding shoulder location to correspond to said calculated modified amount for each layer, and;

generating a signal for stoppage of the flyer frame when said predetermined full amount of the roving is wound on the bobbin from an empty state of the bobbin, thereby causing the end of the roving to be situated at the desired vertical location of the bobbin.

According to the present invention a flyer frame is also provided, comprising:

a draft part for issuing a roving;

a bobbin rail on which a bobbin is rotatably mounted;

means for rotating the bobbin for winding the roving on the bobbin;

first switching means for reciprocating the bobbin rail so that layers of the roving are created to form a package of the roving of a desired shape having a pair of conical shoulder portions;

second switching means for obtaining a switching of the movement of the bobbin rail which is different from the reciprocating movement obtained by the first switching means;

means for detecting a desired vertical location of the bobbin rail for the stoppage of the flyer frame;

means for calculating, at said desired vertical location of the bobbin rail as detected, a residual amount of the roving until the full bobbin state is obtained, as the predetermined amount of the roving at the full bobbin condition minus the actual amount of the roving on the bobbin measured by the measuring means;

means for determining a condition where the calculated residual amount is equal to or less than the amount of the roving corresponding to layers of a first predetermined number during the normal winding process;

means for calculating, upon said determination, based on the calculated residual amount, a modified amount of the roving for layers of a second predetermined number until the full bobbin state is obtained, each of which corresponds to a stroke of the bobbin rail from a preceding shoulder location, exceeding said desired position and which makes the end of the roving to be situated on said desired location for the stoppage when the full bobbin state is obtained;

means for operating said second switching means to obtain a switching of the bobbin rail at a location which makes the amount of the roving from a preceding shoulder location to correspond to said calculated, modified amount for each layer, and;

means for generating a signal for stoppage of the frame when said predetermined full amount of the roving is wound on the bobbin from an empty state of the bobbin, thereby causing the end of the roving to be situated on a desired vertical location of the bobbin.

According to the present invention, upon the determination of the residual amount of the roving equal to or smaller than the roving amount corresponding to normal strokes of the bobbin rail of a predetermined number, a modified amount of a roving for each stroke from a shoulder position to a position exceeding the desired stopping position of the bobbin rail is calculated until the full bobbin state is obtained, which allows the bobbin rail to be stopped at the desired position upon the full bobbin state, and the switching of the bobbin rail is done at the shoulder position and the position which makes the roving amount from the shoulder to correspond to the desired amount of each stroke. As a result, control is simplified, while obtaining a stoppage of the bobbin rail at a desired vertical location at the full bobbin state.

BRIEF EXPLANATION OF ATTACHED DRAWINGS

DESCRIPTION OF PREFERRED EMBODIMENTS

Figure 1:
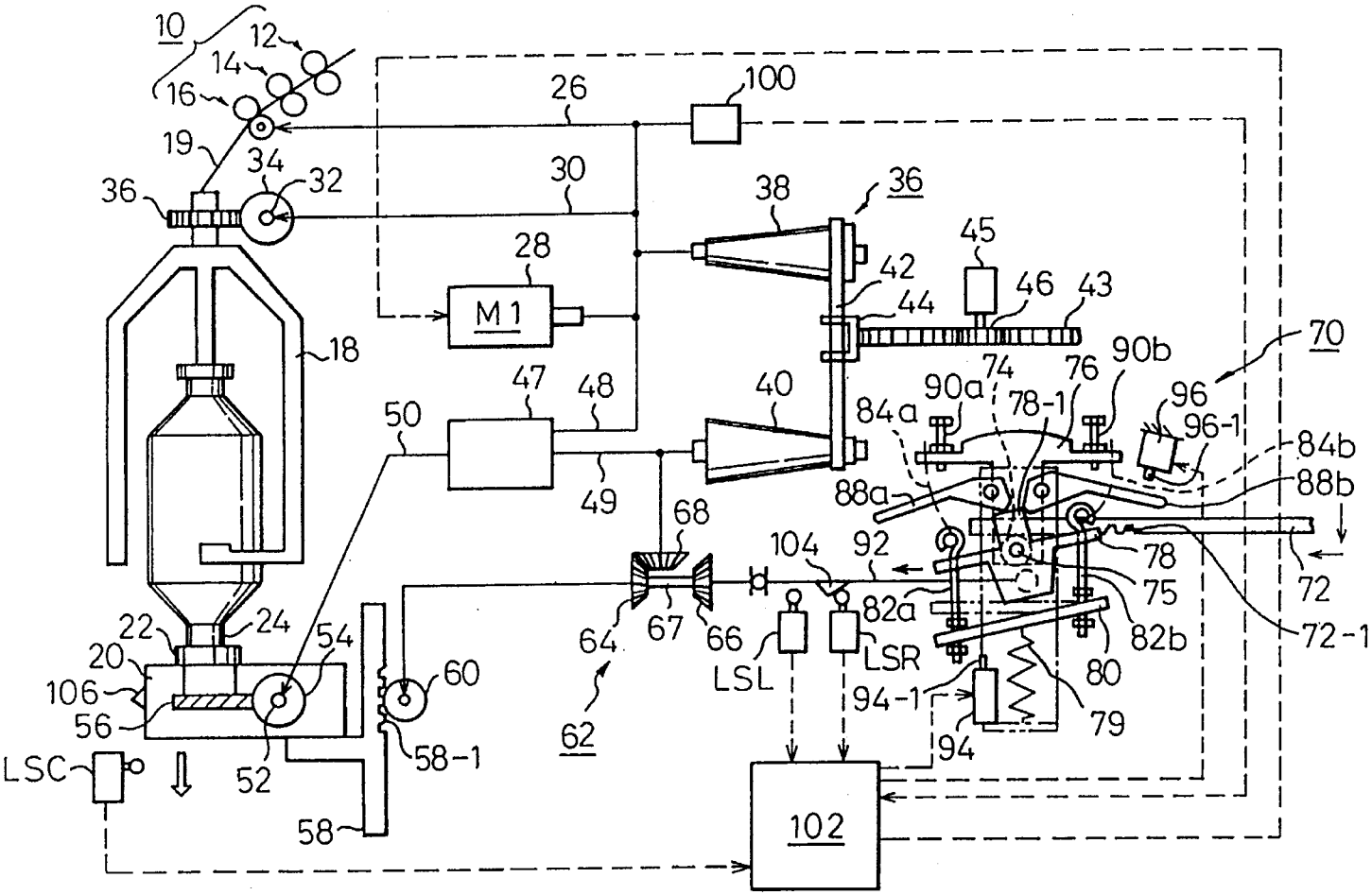
FIG. 1 is a schematic view of a flyer frame to which the present invention is applied.

FIG. 1 shows an embodiment where the present invention is applied to a flyer frame having a cone drum type speed variation apparatus. Namely, in FIG. 1, the flyer frame includes, at its essential parts, a draft part 10, which is constructed by three pairs of rollers, i.e., back rollers 12, middle rollers 14 and front rollers 16, and flyers 18. The flyer frame is further provided with a bobbin rail 20, on which bobbin holders 22 for mounting bobbins 24 are rotatably mounted. A transmission train 26, which includes a belt transmission mechanism (not shown) and a gear transmission mechanism (not shown), is provided for a kinematic connection of the bottom front draft roller 16 of the draft part 10 with a main electric motor (M1) 28, so that the rotating movement from the motor 28 is applied to the bottom front roller 16. A transmission train 30 is also provided for obtaining a kinematic connection of the electric motor 28 with a drive shaft 32, on which a drive gear 34 is mounted. The drive gear 34 engages with a driven gear 36 on the flyer 18, so that a rotating movement from the motor 28 is applied to the flyer 18.

A cone drum type speed variation unit 36 includes a first and second cone drums 38 and 40 arranged in parallel, while oppositely tapered, and a belt 42 looping between the first and second cone drums 38 and 40. The first cone drum 38 is connected to the electric motor 28 for receiving the rotating movement therefrom. As well known manner, the position of the belt 42 is varied along the axial direction in accordance with the amount of the roving wound on the bobbin 24, in such a manner that the more the amount of the roving, the smaller the rotating speed of the outlet cone drum 40. In other words, the more the amount of the wound roving, the further the belt 42 is to be moved in the left-handed direction in FIG. 1. In order to obtain such a movement of the belt 42, a long rack 43 is provided, which is connected to a belt guide member 44. An electric motor 45 is provided, which has a rotating shaft, on which a pinion 46 is fixed, so that the pinion 45 meshes the long rack 43. Thus, a rotating movement of the pinion 46 by the motor 45 causes the long rack 43 to be moved along the direction of the axis of the cone drums, so that the belt 42 is desirably moved along the direction parallel to the axis of the cone drums.

A differential mechanism 47 includes a first and second inlet shafts 48 and 49, and an outlet shaft 50. The first inlet shaft 48 is, also, connected to the electric motor 28 for receiving the rotating movement therefrom, while the second inlet shaft 48 is connected to the second cone drum 40 of the cone drum speed variation unit 36 for receiving the varied rotating speed from the cone drum 40 in accordance with the amount of the wound roving, so that, at the outlet shaft 50 of the differential mechanism 43, a rotational speed is obtained, which is the rotational speed of the first inlet shaft 48 corresponding to that of the electric motor 28 plus the rotational speed of the second inlet shaft 49 corresponding the amount of the wound roving. The outlet shaft 50 is connected to a bobbin shaft 52, on which a gear 54 is fixed. The gear 54 engages with a bobbin wheel 56 connected to the bobbin holder 22, so that the combined rotational speed from the differential mechanism 47 is applied to the bobbin 24 on the bobbin holder 22.

Fixedly connected to the bobbin rail 20 is a lifter rack 58 defining a rack portion 58-1, with which a pinion 60 engages. The pinion 60 receives the rotational movement from the second cone drum 40 via a vertical movement switching unit 62. The unit 62 is constructed by a pair of axially spaced, faced bevel gears 64, 66, which are axially slidable by a spline sleeve shaft 67, and a bevel gear 68 arranged between the gears 64 and 66 and connected to the second cone drum 40. The shaft 67 is moved between a position where the inlet gear 68 engages with the first outlet gear 64, so that a rotational movement of the of the pinion 60 in one direction corresponding to a vertical movement of the lifter rack 58 in one direction (downward direction) is obtained, and a position where the inlet gear 68 engages with the second outlet gear 66, so that a rotational movement of the of the pinion 60 in the opposite direction corresponding to a vertical movement of the lifter rack 58 in the opposite direction (upward direction) is obtained. As a result, an reciprocal vertical movement of the bobbin rail 20 connected to the lifter rack 58 is obtained.

The bobbin formation device 70 is itself well known and is, for example, described in EP 0503518A1 (corresponding to U.S. Pat. No. 5,259,179). The device 70 is constructed by a rack anchor bar 72 defining a rack portion 72-1, a pinion 74 having an axis 75 meshing with the rack portion 72-1, a stagger horn 76 rocking about the axis of the pinion 74, a reversing bracket 78 which is rotatable about the axis 75, a beam 80 which is spaced from the reversing bracket 78 and connected to a fixed member by means of a spring 79, a pair of rods **82*a* and 82*b* connecting ends of the reversing bracket 78 and the beam 80, a pair of chains 84*a* and 84*b* for connecting the stagger horn 76 at their ends with the corresponding rods 82*a* and 82*b*, a pair of swallow-shaped rotatable catches 88*a* and 88*b* and a pair of presser screws 90*a* and 90*b* on the stagger horn 76**.

In the condition of the switching unit 62 where the inlet gear 68 engages with the first outlet gear 64, the rotation of the shaft 67, i.e., the pinion 60 engaging the lifter rack 58, is such that the bobbin rail 20 moves downwardly. The rack anchor bar 72 is, at its one end (not shown), slidably supported by an anchor bar bracket (not shown) which is vertically reciprocated together with the bobbin rail 20, and which is, at the other end, formed with the rack portion 72-1 engaging with the pinion 74 integral to the stagger horn 76. Thus, due to the vertical reciprocal movement of the bobbin rail 20, a rocking movement of the rack anchor bar 72 is generated, which causes the stagger horn 76 to be to be rocked about the axis of the pinion 74. Namely, a downward movement of the bobbin rail 20 causes the stagger horn 76 to be rocked in a clockwise direction, so that the bracket 78 is, at its one end, against the force of the spring 79, urged to move upwardly via the chain **84*a* and the rod 82*a*, on one hand, and so that the reversing bracket 78, which is now located in a right-handed raise position as shown, is urged to be rotated in the clockwise direction via the second rod 82*b*, on the other hand. The further clockwise movement of the stagger horn 76 allows, finally, the presser screw 90*b* to be engaged with the catch 88*b*, which causes the catch 88*b* to be disengaged from a engaging portion 78-1 of the reversing bracket 78, causing the latter to be quickly rotated in the clockwise direction to take a left-handed raised position. This clockwise movement of the bracket 78 is transmitted, via a reversing rod 92, to the sleeve shaft 67, so that the latter is moved to the position where the bevel gear 68 engages with the second switching gear 66, which causes the direction of the rotation of the shaft 67 to be reversed until the a condition is obtained where the catch 88*a* is now engaged with the engaging portion 78-1 of the reversing bracket 78. Thus, the direction of the movement of the bobbin rail 20 is switched to the upward direction. Namely, a upward movement of the bobbin rail 20 causes the stagger horn 76 to be rocked in a counter clockwise direction, so that the bracket 78 is, at the other (right handed) end, against the force of the spring 79, urged to move upwardly via the chain 84*b* and the rod 82*b*, on one hand, and so that the reversing bracket 78, which is now in the left-handed raised position, is urged to be rotated in the counter clockwise direction via the first rod 82*a*. The further counter clockwise movement of the stagger horn 76 allows, finally, the presser screw 90*a* to be engaged with the catch 88*a*, which causes the catch 88*a* to be disengaged from a engaging portion 78-1 of the reversing bracket 78, causing the latter to be quickly rotated in the counter clockwise direction to the right-handed raise position as shown in FIG. 1. This counter clockwise movement of the bracket 78 is transmitted, via a reversing rod 92, to the sleeve shaft 67, so that the latter is moved to the position where the bevel gear 68 engages with the first switching gear 64, which causes the direction of the rotation of the shaft 67 to be reversed, thereby the direction of the movement of the bobbin rail 20 to be switched to the downward direction. Finally, the pinion 74 is connected also to the electric motor 45 for operating the long rack 43 by a not shown transmission train, so that the rotating movement of the pinion 74 by the motor 45 causes the rack anchor bar 72 to be moved along its length so that an effective arm length of the latter is gradually reduced as the winding proceeds. Such a reduction of the effective arm length causes the rocking movement of the stagger horn 76 to be much quicker, so that a switching of the reversing bracket between the right hand side raised position and the left hand side raised position occurs much earlier. Thus, a switching of the movement of the bobbin rail 20 between the upward movement and the downward movement occurs much earlier. In other words, a range of the vertical movement of the bobbin rail 20 is reduced as the winding process proceeds. As a result, a conical shoulder shape of the roving package on the bobbin 24** is obtained.

According to the present invention, an air cylinder 94 is provided at a location below the beam 80 at its left side. The cylinder 94 includes a piston rod 94-1, which, when the piston rod 94-1 is extended, engages with the beam 80, so that the latter is upwardly moved to a position just before it is switched. Furthermore, another air cylinder 96 is arranged slightly above the second or right-handed swallow tail shaped catch **88*b*. The air cylinder 96 includes a piston rod 96-1, which is, when extended, engaged with the catch 88*b*, so that the latter is disengaged from the engaging portion 78-1 of the stagger horn 76. During the downward movement of the bobbin rail 20, where the gear 68 meshes the first switching gear 64 and the stagger horn 76 rocks in the clockwise direction, the air cylinder 94 is first energized, so that its piston rod 94-1 is extracted. The extraction of the piston rod 94-1 causes the beam 80 to be moved upwardly to a position just before the switching, so that the reversing bracket 78 is urged to be rotated in the clockwise direction, while an actual switching of the reversing bracket does not, at this stage, occur, due to the fact that the reversing bracket 78 engages, at its engaging portion 78-1, with the second catch 88*b*. Then, at a desired location earlier than the position where the switching of the bobbin rail 20 from the downward movement to the upward movement for the normal conical shoulder formation operation of the roving package, the switching cylinder 96 is energized, so that its piston rod 96-1 is extracted, which causes the catch 88*b* to be rocked in the clockwise direction, causing the latter to be disengaged from the reversing bracket 78. As a result of the disengagement of the catch 88*b* from the reversing bracket 78, the latter is quickly rotated in the clockwise direction, so that the reversing rod 92 is moved in the left-handed direction to the position where the middle gear 68 engages the second switching gear 66, thereby causing the bobbin rail 20** to be switched to the upward movement.

Next, as shown in FIG. 1, an encoder 100 is connected to the front, bottom roller 16 for issuing a signal indicative of the amount of the roving 19 as produced, which is introduced into a control circuit 102 which will be fully described later. Connected also to the control circuit 102 are limit switches LSL and LSR. The right handed limit switch LSR is made ON by a dog 104 on the reversing rod 92, when the bobbin rail 20 is moved to its upper most position, while the left handed limit switch LSL is made ON by the same dog 104, when the bobbin rail 20 is moved to its lowermost position. In other words, signals indicating that the bobbin rail 20 is moved to the uppermost and lowermost positions are issued from the limit switches LSR and LSL, respectively. Connected, further, to the control circuit 102 is a limit switch LSC is made ON by contacting with a dog 106 on the bobbin rail 20 when the bobbin rail 20 is moved to a desired vertical position of the bobbin rail 20 only during the upward movement of the bobbin rail 20, which position is located at, substantially, the center of a vertical stroke movement the bobbin rail and which is determined so that it is suitable for executing an automated piecing operation at the following fine spinning process. Namely, a signal is supplied to the control circuit when the bobbin rail 20 is moved to the desired position during its upward movement.

Now, a construction of the control circuit 102 will be explained. In a conventional way, the control circuit 102 is constructed as a microcomputer unit, which includes elements such as a central processing unit (CPU) and memories. An operation of the control circuit, which is realized by a program stored in the memories, will now be explained with reference to a flow chart in FIG. 2. During a usual winding operation, at step S1, it is judged if the uppermost position of the bobbin rail 20 is obtained, which is done by detecting a switching of the right handed limit switch LSR between an OFF and ON conditions. Upon a detection of the uppermost position (Yes result as the step S1), the routine flows into a step S2, where a measurement of the amount of the roving 19 issued from the front rollers 16 of the drafting unit 10 is commenced. Namely, a signal from the encoder 100 upon the detection of the uppermost position of the bobbin rail 20 is stored in the memory. At step S3, it is judged if the lowermost position of the bobbin rail is obtained, which is done by detecting a switching of left handed limit switch LSL between an OFF and ON positions. Upon a detection of the lowermost position of the bobbin rail 20 (Yes result at the step S3), the measurement of the roving amount by the encoder 100 is completed and the detected value is stored in the memory. An amount L of the roving 19 during a downward single stroke movement of the bobbin rail 20 is, thus, measured. After the measurement of the amount L of the roving during the single downward stroke, the direction of the movement of the bobbin rail 20 is switched to the upward direction. Then, at step S4, it is checked if the limit switch LSC detects the desired position A for the stoppage of the bobbin rail 20 during the upward movement thereof. Upon a detection of the suitable position A for the stoppage (yes result at the step S4), the routine flows into a step S5, where a measurement of the residual amount R of the roving 19 up to a full bobbin condition is executed, which corresponds to a preset total amount D of the roving in a full bobbin minus the amount d of the roving actually wound on the bobbin 24 from its empty state. The former amount D is a constant value, and the latter amount d is an accumulated amount of the roving from the empty state, which is an integrated value of the measured values by the encoder 100. At the following step S6, a determination is done if the residual winding amount R of the roving 19 up to the full bobbin condition is equal to or smaller than the amount of the roving corresponding to the last four layers of the roving on the bobbin, that is equal to 4×L. When the residual winding amount R of the roving up to the full bobbin state is larger than the amount of the roving for the last normal four layers 4×L (no result at the step S6), the routine between the steps S1 to S5 is repeated.

When a determination is obtained that the residual winding amount R of the roving up to the full bobbin state is equal to or smaller than the amount of the roving for the last normal four layers 4×L (yes result at the step S6), the routine goes to step S7, where the residual amount of the roving R up to the full bobbin state is divided by 4 to obtain a roving amount Q to be wound for each 4 modified reciprocal strokes up to the full bobbin state, which amount Q corresponds to a modified length of the reciprocal stroke of the bobbin rail 20 for winding one of 4 layers of roving up to the full bobbin state. At the following step S8, a determination is done if the bobbin rail 20 is moved to the uppermost position , i.e., if the ON signal from the limit switch LSR is issued. When it is determined that the uppermost position of the bobbin rail 20 is obtained (yes result at step S8), the routine goes to step S9, where a measurement of the roving amount S from the uppermost position of the bobbin rail 20 is commenced. At S10, it is determined if the roving amount S from the uppermost position of the bobbin rail 20 has reached the desired roving amount Q for each of 4 reciprocal movements of the bobbin rail 20 up to the full bobbin state, calculated at the step S7. A determination of the roving amount S from the uppermost position equal to or larger than the desired amount Q (yes result at step S10) causes the routine to go to step S11, where the cylinder 96 is energized, which causes its piston 96-1 to be extended, so that the right-handed swallow tailed catch **88*b* to be rotated about its own axis of the rotation, thereby the catch 88*b* to be disengaged from the reversing bracket 78. Due to the force the spring 79, the reversing bracket 78 is quickly rotated in clockwise direction from the shown right-handed raised position to the left-handed raised position, so that the switching rod 92 is moved, from the left-handed direction from the position where the gear 68 engages with the left-handed gear 64, to the position where the gear 68 engages the right handed gear 66, so that the direction of the rotation of the wheel 60 is switched, causing the movement of the bobbin rail 20 to be switched from to the upward direction. It should be noted that, during the downward movement of the bobbin rail 20 from the uppermost position, prior to the energizing of the second cylinder 96, the first cylinder 94 is energized, so that its piston rod 94-1 is extended, so that the connecting beam 79 is urged to be rotated in the clockwise direction to take a position just before the switching to the designated movement. Thus, the energization of the second cylinder 96 causes the reversing bracket 78** to be instantly rocked in the clockwise direction.

Figure 2:
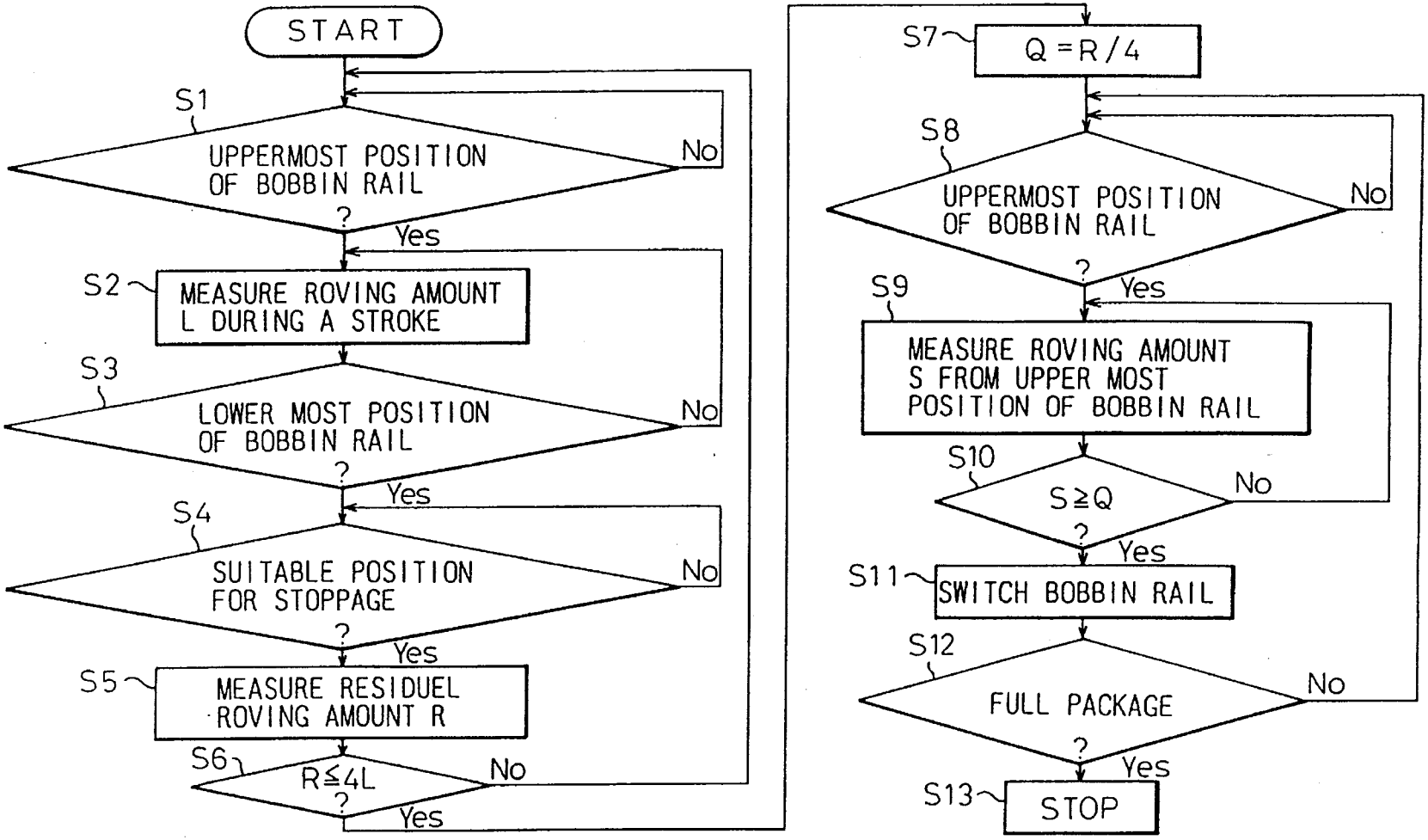
FIG. 2 is a flow chart illustrating a routine performed by a control circuit in FIG. 1.

In FIG. 2, steps S8 to S11 are repeated until the completion of the winding of all of the last four layers of the roving. When the full bobbin condition is detected by the fact that the total roving amount D measure by the encoder 100 from the empty bobbin state (yes result at the step S12), the frame is stopped for the following winding process (step S13).

Figure 3:
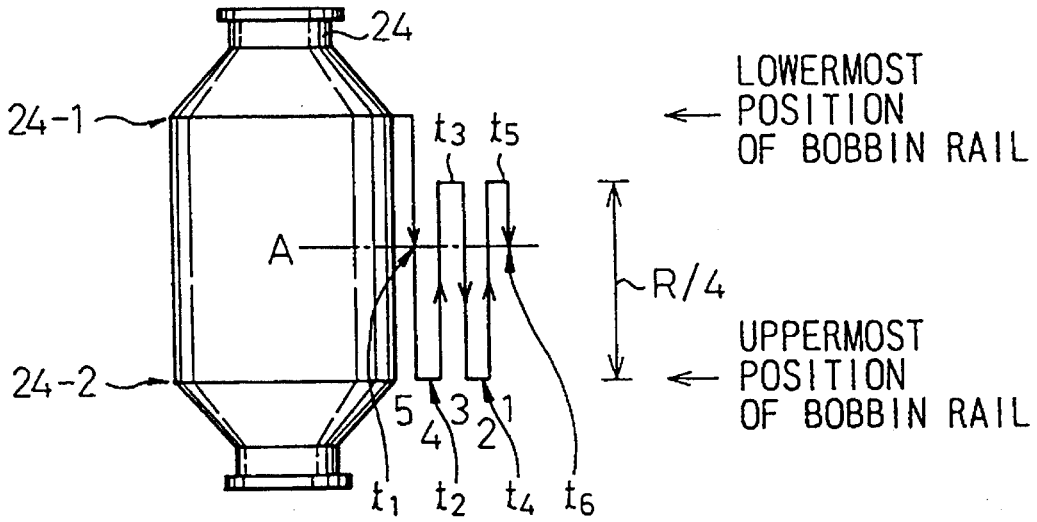
FIG. 3 illustrates how a winding control according to the present invention is done.

FIG. 3 illustrates how a winding of a roving onto a bobbin 24 is done by the execution of the routine in FIG. 2. During a normal winding process, the switching of the movement of the bobbin rail 20 between the upward and downward strokes is caused by the alternate contact of the screws **90*a* and 90*b* with the corresponding catches 88*a* and 88*b*. Thus, an alternate rocking movement of the reversing bracket 78 is obtained. Upon the switching of the movement of the bobbin rail an inching rotation of the electric motor 45 connected to the pinion 74 via the transmission train (not shown) is generated, which causes the pinion 74 to be rotated for a predetermined angle, causing the effective arm length of the rack anchor bar 72 to be shortened, causing the range of the rocking movement of the stagger horn 76 to be reduced, causing the length of the vertical movement of the bobbin rail 20 to be shortened. Due to such an inching reduction of the vertical movement of the bobbin rail 20 at every time upon the directional switching, the length of the roving layer is gradually reduced, so that the package forms tapered shoulder portions 24-1 and 24-2 at its top and bottom ends as shown in FIG. 3. During such a normal winding operation, upon each upward stroke of the bobbin rail 20, the desired stoppage position A is detected (step S4 in FIG. 2) by the limit switch LSC, and the remaining amount of the roving R is calculated as the desired total amount D of roving minus the actual total wound amount t of the roving from the empty state of the bobbin (step S5 in FIG. 2). A determination that the residual amount of the roving up to the full bobbin state is equal to or smaller than the amount of the roving for 4 vertical stroke movements, 4×L (step S6), means that the upward movement of the bobbin rail 20 is for winding the last 5th roving layer up to the full bobbin state. The amount Q corresponding one fourth of the residual roving amount R is calculated (step S7 of FIG. 2). This timing is shown by $t_1$ in FIG. 3. Note: the direction of the movement of the roving is opposite to that of the bobbin rail 20, as will be easily understood from FIG. 3. Namely, the bottom end 24-2 of the package corresponds to the uppermost position of the bobbin rail 20, while the top end 24-1 of the package corresponds to the lowermost position of the bobbin rail 20. When the bobbin rail reaches the uppermost position ($t_2$), the direction of the movement of the bobbin rail 20 is switched to the downward direction for commencing a winding of the last 4th layer. Upon the detection of the length (R/4) of the downward stroke corresponding the amount Q which is the roving amount for the modified stroke ($t_3$), the actuator 96 is operated (step S11 in FIG. 3) so that direction of the movement of the bobbin rail 20 is switched toward the upward direction to commence the modified winding of the roving for the last 3rd layer. When the bobbin rail is moved to the uppermost position ($t_4$), the direction of the movement of the bobbin rail is switched to obtain the downward movement for commencing the winding of the roving of last second layer. Upon the detection of the length of the downward stroke corresponding the amount Q ($t_5$), the actuator 96 is again operated, so that direction of the movement of the bobbin rail 20 is switched toward the upward direction to commence the winding of the roving for the last layer. When the bobbin rail is moved to the desired vertical location A ($t_6$), the movement of the bobbin rail 20 is stopped (step S13 in FIG. 3). At timing t1 on the position A during the winding of the last 5th layer by the upward movement of the bobbin rail, the residual amount R is calculated (step S5**), and the amount R is divided by 4 to obtain the roving amount of Q for each stroke. The total roving amount from the desired stoppage position A during the winding of the last 5th layer to the full bobbin state is the sum of the roving amount from the point $t_1$ to $t_6$, which is equal to 4Q, which is equal to the residual roving amount calculated at the timing $t_1$. It should be noted that the residual amount R for the last four layers calculated at the desired stopping position A during the upward stroke for winding the last 5th layer is usually smaller than the amount of the roving wound for a usual stroke multiplied by four or larger than the amount of the roving wound for an usual stroke multiplied by two strokes of the bobbin rail. In other words, the following relationship is obtained.

$$2\times L \leqq R \leqq 4\times L.$$

Furthermore, since Q=R/4

$$L/2 \leqq Q \leqq L.$$

As illustrated above, according to this embodiment of the present invention, when the residual amount R of the last four layers of the roving becomes smaller than the roving amount of the last four layers at the normal stroke, 4×L, i.e., when it is determined that this stroke is for winding the last 5th stroke, the suitable or modified amount Q of the roving for one layer is calculated as the amount R divided by 4. A switching of the movement of the bobbin rail 20 from the upward direction to the downward direction is done usually at the locations on the shoulders 24-2, while the switching of the movement of the bobbin rail from the downward direction to the upward direction is done at a location different from that on the shoulder 24-1, when the calculated modified stroke Q from the uppermost position is obtained. As a result, the measurement of the total amount d of the roving conforming to the predetermined full bobbin amount D causes the bobbin rail to be automatically located to the stoppage position A. Furthermore, the determination of the residual amount R smaller than the amount of the roving for the last usual four layers 4×L done at the desired stoppage location A during the upward stroke of the bobbin rail 20, the stoppage of the bobbin rail 20 is done during the upward stroke of the bobbin rail when the full bobbin state is obtained. The present invention is advantageous in that, as for the detection of the vertical position of the bobbin tail 20, a simplified construction for the detection of a fixed vertical position such as the limit switch LSC is sufficient. Contrary to this, in the prior art system, an encoder type sensor for obtaining a continuous detection of the position of bobbin rail is essential for stoppage of the bobbin rail at a desired location with a constant full bobbin length, causing the system to be complicated, on one hand, and the system to be expensive, on the other hand.

In place of the package formation device 31 for obtaining a mechanical switching operation of the direction of the movement of the bobbin rail 20, an electrical switching device can be employed which is known and which includes, in place with the main electric motor 28, an auxiliary electric motor which is purely for controlling the vertical movement of the bobbin rail, so that a purely electrical switch of the direction of the movement of the bobbin rail 20 is obtained.

The residual amount R of the roving which commences the modified stroke control of the bobbin rail is not necessarily the roving amount of a roving amount of a single stroke multiplied by 4, i.e., the roving amount at the last four strokes prior to the full bobbin state. In other words, the residual roving amount R can be the amount of the roving of last strokes of the bobbin rail 20 of number other than 4 if the number is an even number.

Figure 4:
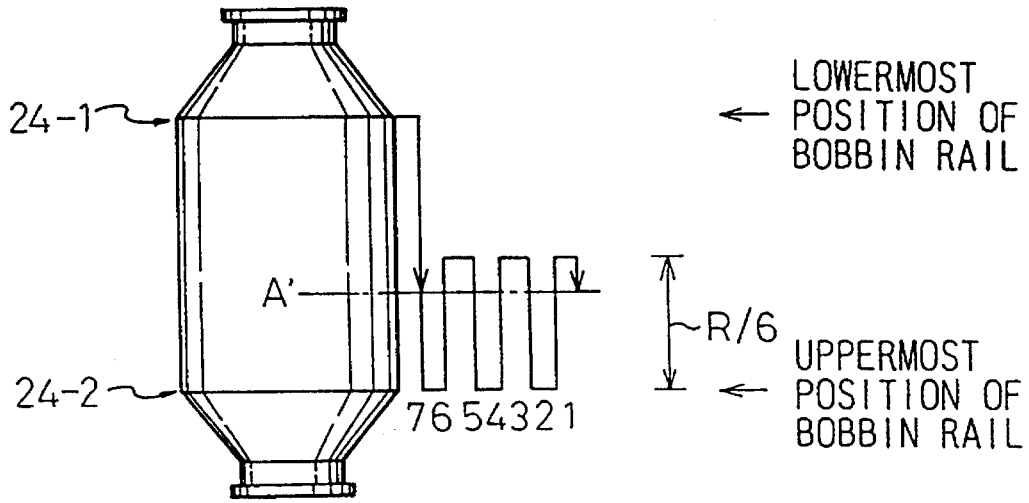
FIG. 4 is similar to FIG. 3 but illustrates a modification.

The number n of the divisor, which is to the residual roving amount R and which is for obtaining the modified desired roving amount Q, is not necessarily 4, and it is sufficient if the number is even number, if the quotient R/n is smaller than the length of the normal stroke L just before executing the stroke modifying operation, and if the position of the bobbin rail after production of the roving for the amount of Q from the preceding normal switching position at a shoulder 24-1 or 24-2 (uppermost position of the bobbin rail 20) exceeds the predetermined position A of the end of the bobbin rail for its stoppage. Namely, in a modified embodiment in FIG. 4, the desired stopping position of the bobbin rail A' is slightly raised, i.e., the position of the roving is slightly lowered, when compared with the position A in the embodiment in FIG. 3. After the determination that the residual amount of the roving up to the full bobbin condition R is smaller than the roving amount for the last layers of the predetermined number, the residual roving amount R is divided by 6 to obtain the amount Q of the roving for the modified stroke. The setting is such that the modified stroke from the uppermost position exceeds the desired stopping position A' of the roving. In this modification, the switching of the movement of the bobbin rail at the location different from the normal switching location is done three times. This modification also allows the bobbin rail 20 to be stopped at the desired vertical location A' during its upward stroke when the full bobbin state is detected.

Figure 5:
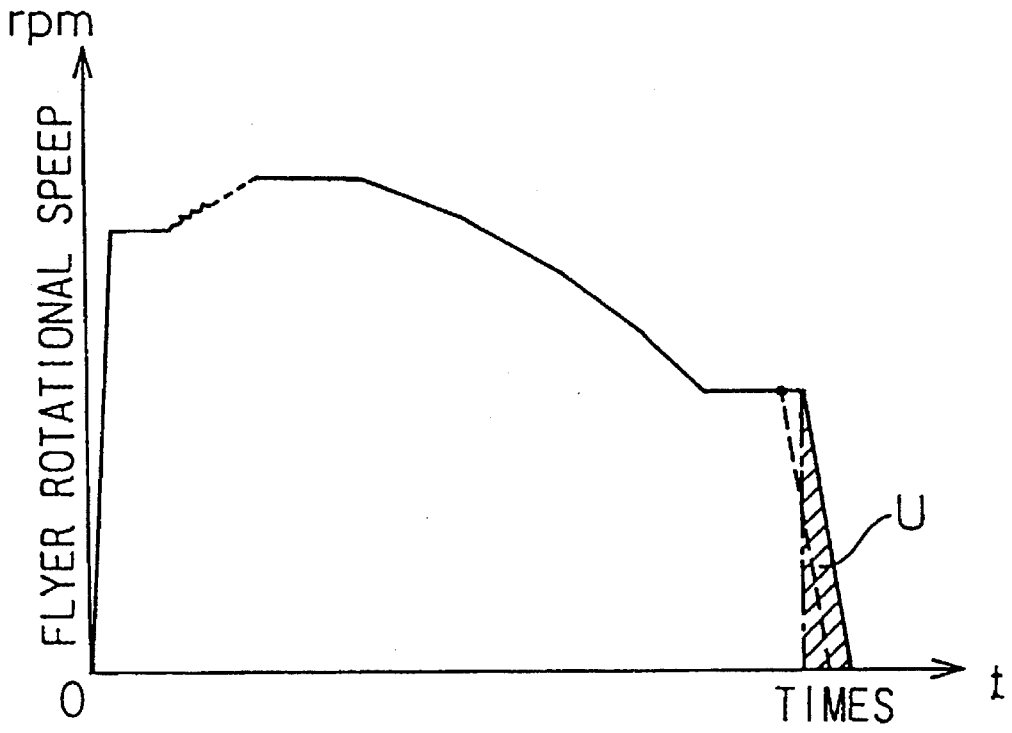
FIG. 5 illustrates how a rotating speed of a flyer in the flyer frame is change in a complete cycle of a winding process from an empty state to a full bobbin state.

FIG. 5 shows a second embodiment of the present invention, wherein the signal for the stoppage of the flyer frame upon the full bobbin state (step S13 in FIG. 2) is issued earlier for compensating for an inertia spinning amount U which is obtained after the issuance of the stoppage signal due to the effect of inertial rotation. Namely, in this embodiment, irrespective of the existence of the inertial rotation after the stoppage signal, the full bobbin can have the desired amount of the roving as wound. Namely, the control circuit 102 calculates the amount of the spinning amount L during a single stroke of the bobbin rail 20 from its uppermost position to its lowermost position, and a spinning speed is calculated based on this measured value. Namely, the roving amount during the period of 10 seconds is calculated, and the spinning speed is obtained as the spinning amount during 10 seconds divided by 10 (second). A time T for stoppage of the flyer frame at its full bobbin state can be calculated by $$T=(N_{1/N}2)\times 10,$$

when a set value of speed reduction time (a speed reduction time at the maximum rotating speed of the frame) of an inverter device per se known for the main motor M1 is, for example, 10 seconds, a time for stoppage T upon the full bobbin condition is calculated, where $N_1$ is an instruction value of the maximum rotating speed to the inverter and $N_2$ is an actual instruction value of the rotating speed to the inverter at the full bobbin stoppage condition. Furthermore, the inertia spinning amount U upon the full bobbin stoppage is, based on the spinning speed SP and the stoppage time T, calculated by $$U=(SP\times T)/2$$

As explained in FIG. 2 at steps S12 and S13, a stoppage signal is issued when the actual spinning amount reaches the full package roving length D. Thus, in this modification, the inertial roving amount U is considered when the full bobbin roving amount D is calculated. Namely, when the actual spinning amount d is equal to the full bobbin roving amount D minus the inertia roving amount, the stoppage signal is issued for obtaining a stoppage of the flyer frame. In other words, the signal for the stoppage of the flyer frame is issued earlier than the estimated timing for obtaining the full bobbin state for the time corresponding to the inertia spinning amount. As a result, the bobbin rail can be precisely stopped at the desired location irrespective of the existence of the inertia spinning amount after the issuance of the stoppage signal.

In the above embodiment, the signal for the stoppage of the frame is issued when the actual spinning amount d reaches the full bobbin amount D minus the inertia spinning amount U. In place of such a solution, at step S5 in FIG. 2, the remaining roving amount R is calculated so that it is larger than the normal value by the difference between the roving amount at the full bobbin state and the actual wound roving amount for the value corresponding to the inertia spinning amount. The stoppage signal is issued when the residual roving amount calculated as above reaches the above modified remaining roving amount R, which allows the bobbin rail to be stopped at the desired location irrespective of the existence of the inertia rotation of the flyer frame after the issuance of the stoppage signal.

Figure 6:
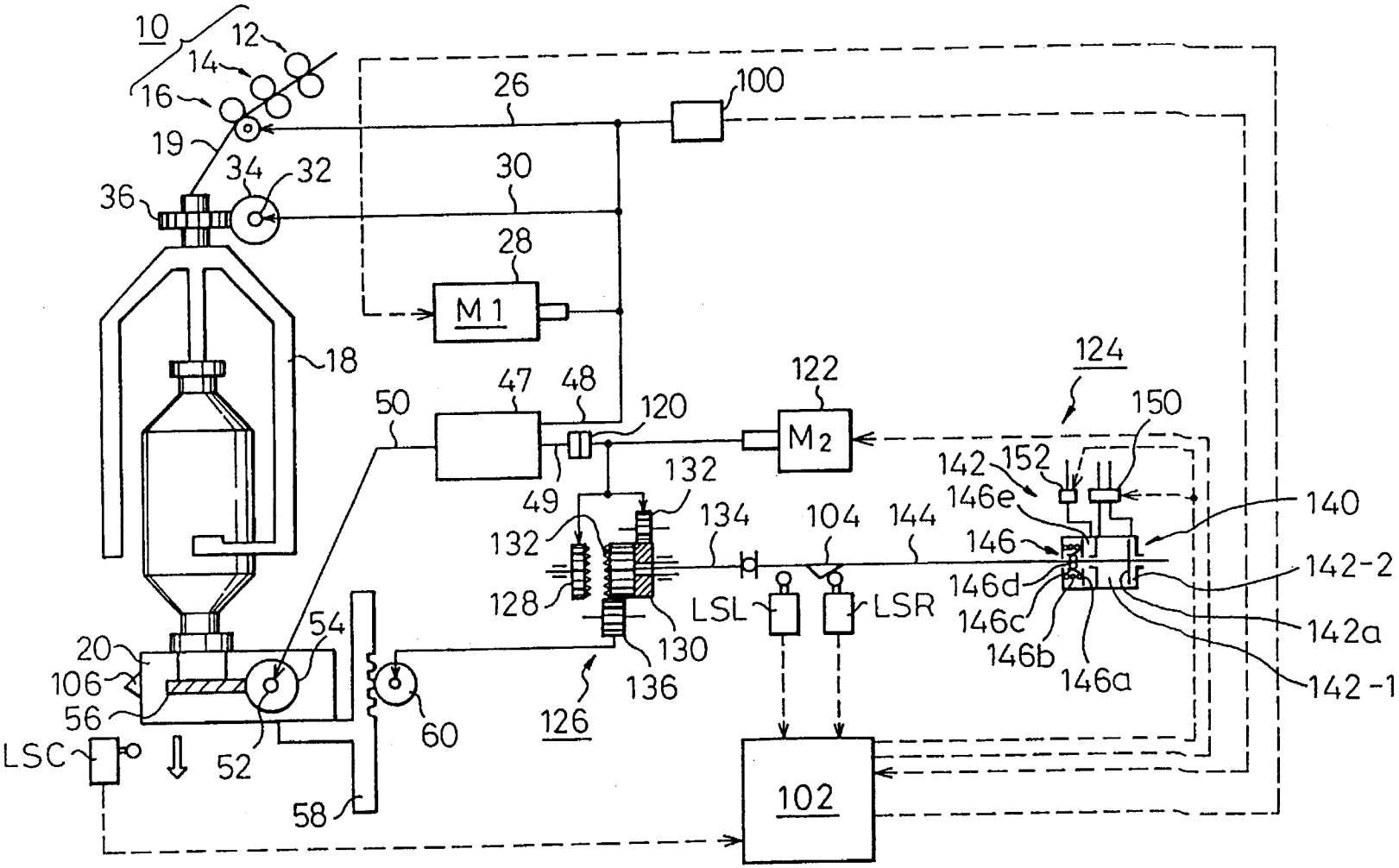
FIG. 6 is a schematic view of a different type of a flyer frame to which the present invention is also applied.

FIG. 6 illustrates an application of the idea of the present invention to a flyer frame without the cone drum speed variation mechanism 36 as shown in FIG. 1. In FIG. 6, parts of the same function shown in FIG. 1 are illustrated by the same numbers, and a detailed explanation thereof is eliminated. Only the different points will be illustrated. Connected to the first inlet shaft 48 of the differential mechanism 47 is the first main motor 28 as similar to the first embodiment. Connected to the second inlet shaft 49 of the differential mechanism 47 is, unlike to the first embodiment, a electro-magnetic clutch 120, which is connected to a second main electric motor 122. Reference numeral 124 denotes a bobbin formation device of a completely different structure from that in FIG. 1. Namely, the bobbin formation device 124 includes a switching unit 126 for switching the movement of the bobbin rail 20 between the upward movement and the downward movement. The unit 126 includes a pair of spaced apart driven gears 128 and 130, which are driven by the second electric motor 122. An intermediate gear 132 is provided for the second driven gear 130, so that the first and second driven gears 128 and 130 are rotated in opposite directions. A switching gear 132 is located between the driven gears 128 and 130, and is mounted on a moving shaft 134. The intermediate gear 132 on the shaft 134 engages with a gear 136, which is in connection with the wheel 60 meshing with the lifter rack 58 for reciprocating the bobbin rail 20. The bobbin formation device 124 is further provided with a switching unit 140, which includes a pneumatic pressure cylinder 142, a reversing rod 144 for connection of the cylinder 142 with the moving shaft 134, a braking device 146 provided in the cylinder 142 for generating a braking force to the reversing rod 134, and a first and second electro-magnetic valves 150 and 152 for controlling the air pressure in the cylinder 142. The cylinder 142 is provided with a piston **142*a* defining pressure chambers 142-1 and 142-2, to which an air pressure source (not shown) is selectively or alternately opened by means of the first control valve 150. Namely, the valve 150 is switched between a first condition where the first chamber 142-1 is opened to the air pressure source, causing the piston 142*a* to be moved in the right-handed position, thereby causing the bobbin rail 20 to be moved downwardly, and a second condition where the second chamber 142-2 is opened to the air pressure source, causing the piston 142*a* to be moved in the left-handed position, thereby causing the bobbin rail 20 to be moved upwardly. The braking unit 146 is provided with a piston 146*a*, which is slidably moved with respect to the piston 142*a*, a spring 146*b* for urging the piston 146*a* to be moved toward the piston 142*a*, and a locking mechanism constructed by an wedge sleeve 146*c* which is integral to the piston 146*b* and locking balls 146*d* arranged inside the wedge sleeve 146*c*. A chamber 146*e* is formed on one side of the piston 146*a*, and is selectively connected to the pressure source by means of the second control valve 152**.

In an operation of the flyer frame in FIG. 6, during the downward movement of the bobbin rail, the piston **142*a*, i.e., the reversing rod 144 is in the right-handed position where the switching wheel 132 engages face to face with the gear 130. The braking chamber 146*e* is disconnected from the air pressure source so that the force of the spring 146*b* causes the braking sleeve 146*c* to be locked to the braking balls 146*d*. Therefore the desired bottom position of the bobbin rail 20 is obtained, the first control valve 150 is switched to the position where the air pressure source is connected to the second chamber 142-2, which urges the piston 142*a* to be moved in the left-handed direction. When the desired bottom position of the bobbin rail 20 is obtained, the second valve 152 is energized, causing the air pressure source to be connected to the chamber 146*e*, so that the braking sleeve 146*d* is moved against the force of the spring 146*b*, which causes the braking sleeve 146*c* to be freed from the braking balls 146*d*. As a result, the braking force between the sleeve 146*c* and the braking balls 146*d* is quickly diminished, so that the reversing rod 144 is, under the pressure in the chamber 142-2, rapidly moved in the left-handed direction to the position where the switching gear 132 is in face to face engagement with the wheel 128, so that the direction of the rotating movement of the wheel 60 is reversed, causing the bobbin rail 20 to be moved upwardly. Switching of the bobbin rail 20 to the downward movement is similarly done. Namely, therefore desired top position of the bobbin rail 20 is obtained the first control valve 150 is switched to the position where the air pressure source is connected to the second chamber 142-1, which urges the piston 142*a* to be moved in the right-handed direction. When the desired top position of the bobbin rail 20 is obtained, the second valve 152 is energized, causing the braking sleeve 146*c* to be freed from the braking balls 146*d*. As a result, the braking force between the sleeve 146*c* and the braking balls 146*d* is quickly diminished, so that the reversing rod 144 is, under the pressure in the chamber 142-1, rapidly moved in the right-handed direction to the position where the switching gear 132 engages with the wheel 130, so that the direction of the rotating movement of the wheel 60 is reversed, causing the bobbin rail 20** to be moved downwardly.

In this construction of the flyer frame, similar to the first embodiment, a bobbin formation operation is normally done, so long as the winding of the roving layer other than the last four layers is done. Namely, the switching of the movement of the reversing rod 144 takes place after a desired amount of the stroke of the bobbin rail 20 to create a pair of spaced apart shoulders 24-1 and 24-1 as shown in FIG. 3. When the remaining roving amount is smaller than that for winding the last four layers when measured at the desired stoppage position A during the winding of the last fifth roving layer (FIG. 3), the point for the switching of the bobbin rail 20 from the upward direction to the downward direction is done at the usual position at the shoulder 24-2, while the point for the switching of the bobbin rail 20 from the downward direction to the upward direction, i.e., the point of the energization of the braking unit 146, is different from the shoulder 24-1 or becomes earlier, so that the modified stroke Q, which is calculated as the remaining amount R at the winding of the last 5th layer, divided by 4 (the step S7 in FIG. 2) is obtained.

We claim:

1. A flyer frame comprising:

a draft part for issuing a roving;

a bobbin rail on which a bobbin is rotatably mounted;

means for rotating the bobbin for winding the roving on the bobbin;

measuring means associated with the draft part for providing a measured amount of roving wound on the bobbin;

first switching means for reciprocating the bobbin rail so that layers of the roving are created to form a package of the roving of a desired shape having a pair of conical shoulder portions;

second switching means for obtaining a switching of the movement of the bobbin rail which is different from the reciprocating movement obtained by the first switching means;

means for detecting a desired vertical location of the bobbin rail for the stoppage of the flyer frame;

means for calculating, at said desired vertical location of the bobbin rail as detected, a residual amount of the roving until the full bobbin state is obtained, as a predetermined amount of the roving at the full bobbin condition minus the actual amount of the roving on the bobbin measured by the measuring means;

means for determining a condition where the calculated residual amount is equal to or less than the amount of the roving corresponding to layers of a first predetermined number during the normal winding process;

means for calculating, upon determination of said condition by said determination means, based on the calculated residual amount, a modified amount of the roving for layers of a second predetermined number until the full bobbin state is obtained, each of which corresponds to a stroke of the bobbin rail from a preceding shoulder location, exceeding said desired vertical location of the bobbin rail and which makes the end of the roving to be situated on a desired vertical position on the bobbin for the stoppage when the full bobbin state is obtained;

means for operating said second switching means to obtain a switching of the bobbin rail at a location which makes the measured amount of the roving from a preceding shoulder location to correspond to said calculated, modified amount for each layer, and;

means for generating a signal for stoppage of the frame when said predetermined full amount of the roving is wound on the bobbin from an empty state of the bobbin, thereby causing the end of the roving to be situated on said desired vertical position on the bobbin.

2. A flyer frame according to claim 1 wherein said desired vertical location detecting means detects the desired position when the bobbin rail moves only in one of the directions in the vertical movement of the bobbin rail.

3. A flyer frame comprising:

a draft part for issuing a roving;

a bobbin rail on which a bobbin is rotatably mounted;

means for rotating the bobbin for winding the roving on the bobbin;

measuring means associated with the draft part for providing a measured amount of roving wound on the bobbin;

reversing means for cooperating with the bobbin rail for causing the latter to be moved between a first condition where the bobbin rail moves upwardly and a second condition where the bobbin rail moves downwardly;

a rocking member which is in connection with the bobbin rail and which is rocked between a first and second angularly spaced positions;

operating means for cooperating with the rocking member for causing the reversing means to be switched between the first and second conditions each time the rocking member is rotated to the first or second angularly spaced position, so that layers of the roving are created during a normal winding process to form a package of the roving of a desired shape having a pair of conical shoulder portions;

actuator means acting on the operating means for obtaining a switching of the movement of the bobbin rail on which the bobbin is rotatably mounted;

means for detecting a desired vertical location of the bobbin rail for the stoppage of the flyer frame;

means for calculating, at said desired vertical location of the bobbin rail as detected, a residual amount of the roving until a full bobbin state is obtained, as a predetermined full amount of the roving at the full bobbin state minus the actual amount of the roving on the bobbin measured by the measuring means;

means for determining a condition where the calculated residual amount is equal to or less than the measured amount of the roving corresponding to layers of a first predetermined number during the normal winding process;

means for calculating, upon determination of said condition by said determination means, based on the calculated residual amount, a modified amount of the roving for layers of a second predetermined number until the full bobbin state is obtained, each of which corresponds to a stroke of the bobbin rail from a preceding shoulder location beyond said desired location of the bobbin rail and which makes the end of the roving to be situated on a desired vertical position on the bobbin for the stoppage when the full bobbin state is obtained;

means for operating said actuator means to obtain a switching of the bobbin rail at a location which makes the amount of the roving from a preceding shoulder location correspond to said calculated, modified amount for each layer, and;

means for generating a signal for stoppage of the frame when said predetermined full amount of the roving is wound on the bobbin from an empty state of the bobbin, thereby causing the end of the roving to be situated on said desired vertical position on the bobbin.

4. A flyer frame comprising:

a draft part for issuing a roving;

a bobbin rail on which a bobbin is rotatably mounted;

means for rotating the bobbin for winding the roving on the bobbin;

measuring means associated with the draft part for providing a measured amount of roving wound on the bobbin;

fluid operated reversing means for cooperating with the bobbin rail for causing the latter to be moved between a first condition where the bobbin rail moves upwardly and a second condition where the bobbin rail moves downwardly;

first control means for controlling an introduction of a fluid pressure to the reversing means for normally reciprocating the bobbin rail so that layers of the roving are created during a normal winding process to form a package of the roving of a desired shape having a pair of conical shoulder portions;

second control means for controlling an introduction of a fluid pressure to the reversing means for obtaining a switching of the movement of the bobbin rail which is different from the normal reciprocating movement obtained by the first control means;

means for detecting a desired vertical location of the bobbin rail for the stoppage of the flyer frame;

means for calculating, at said desired vertical location of the bobbin rail as detected, a residual amount of the roving until a full bobbin state is obtained, as a predetermined full amount of the roving at the full bobbin state minus the actual amount of the roving on the bobbin measured by the measuring means;

means for determining a condition where the calculated residual amount is equal to or less than the amount of the roving corresponding to layers of a first predetermined number during the normal winding process;

means for calculating, upon determination of said condition by said determination means, based on the calculated residual amount, a modified amount of the roving for layers of a second predetermined number until the full bobbin state is obtained, each of which corresponds to a stroke of the bobbin rail from a preceding shoulder location exceeding said desired vertical location of the bobbin rail and which makes the end of the roving to be situated on a desired vertical position on the bobbin for the stoppage when the full bobbin state is obtained;

means for operating said second control means to obtain a switching of the bobbin rail at a location which makes the measured amount of the roving from a preceding shoulder location to correspond to said calculated, modified amount for each layer, and;

means for generating a signal for stoppage of the frame when said predetermined full amount of the roving is wound on the bobbin from an empty state of the bobbin, thereby causing the end of the roving to be situated on said desired vertical position on the bobbin.

5. A method for winding a roving in a flyer frame including a draft part having a front roller, a bobbin rail arranged to be vertically reciprocated, and a bobbin wheel on which a bobbin is mounted, the bobbin wheel being rotatably mounted on the bobbin rail, said method comprising the steps of:

(a) commencing rotation of the bobbin wheel for winding the roving on the bobbin mounted on the bobbin wheel;

(b) rotating the front roller by contact with the roving passing from the front roller to the bobbin;

(c) moving the bobbin rail vertically;

(d) switching the movement of the bobbin rail at vertically spaced positions to obtain a normal vertically reciprocating movement of the bobbin rail to create a desired shape of a roving package on the bobbin with vertically spaced shoulders, said vertically spaced positions corresponding to the shoulders of the package, each vertical movement between said shoulder positions constructing a layer of the roving in the package;

(e) measuring the amount of the roving wound on the bobbin from commencement of winding the roving on the bobbin;

(f) calculating, at a selected position located between the shoulder positions for a stoppage of the roving frame, a residual amount of roving to be wound on the bobbin until a full bobbin is obtained, as a fixed total amount of the roving in a full bobbin minus the measured amount of the roving wound on the bobbin;

(g) determining if the calculated residual amount of the roving is equal to or less than an amount of the roving included in a predetermined number of the last consecutive normal layers of the roving in the package just before the completion of a formation of the full bobbin;

(h) calculating, when it is determined that the calculated residual amount of the roving is equal to or less than an amount of the roving included in the predetermined number of the last consecutive normal layers of the roving, a number of modified layers wound by modified vertically reciprocating movements of the bobbin rail to obtain said residual amount of roving, the modified reciprocating movement being such that the bobbin rail is reciprocated between one of said shoulder positions and a modified position located between the shoulder portions, while the bobbin rail is moved toward the modified position while exceeding a predetermined fixed vertical position for a stoppage of the bobbin rail;

(i) switching the movement of the bobbin rail when an amount of the roving, corresponding to a movement of the bobbin rail from a preceeding shoulder portion to the modified position, is measured; and (j) generating a signal for stoppage of the flyer frame when it is detected that said predetermined full amount of the roving is wound on the bobbin from an empty state of the bobbin, stopping the flyer frame, thereby causing the end of the roving to be automatically situated at a predetermined fixed vertical position on the bobbin.

6. A method according to claim 5, wherein the calculation of the residual amount of the roving is done at the desired vertical location of the bobbin when it is moved in a predetermined direction.

7. A method according to claim 5, wherein said number of modified layers is equal to said predetermined number of the last consecutive normal layers.

8. A method according to claim 5, wherein said number of modified layers is less than said predetermined number of the last consecutive normal layers.

9. A method according to claim 5, further comprising a step of correcting the generation of said stoppage signal, said correcting step comprising calculating an amount of the roving issued by inertial rotation of the flyer frame, and correcting an issuance of the stoppage signal so that it is earlier than the time for obtaining the roving amount corresponding to the full bobbin state for a time corresponding to the inertial amount.

10. A method according to claim 5, further comprising a step of correcting the generation of said stoppage signal, said correcting step comprising calculating an amount of the roving issued by inertial rotation of the flyer frame, and correcting the full amount of the roving used for calculating said residual amount such that it is said predetermined full bobbin amount plus the amount of the roving corresponding to the inertial amount.

* * * * *